United States Patent [19]

Roberts

[11] 4,222,130

[45] Sep. 16, 1980

[54] WATERLESS FLUSH TOILET SYSTEM

[75] Inventor: George C. Roberts, Los Angeles, Calif.

[73] Assignee: Inca-One Corporation, Los Angeles, Calif.

[21] Appl. No.: 7,146

[22] Filed: Jan. 29, 1979

[51] Int. Cl.[3] ..... E03D 5/0016; E03D 5/014

[52] U.S. Cl. ..... 4/321; 4/317; 4/318; 4/398; 4/DIG. 11; 4/DIG. 19

[58] Field of Search ..... 4/321, 317, 318, DIG. 19, 4/DIG. 11, 355, 398

[56] References Cited

U.S. PATENT DOCUMENTS

| | | | |
|---|---|---|---|
| 1,303,358 | 5/1919 | Montgomery | 4/321 |
| 3,079,612 | 3/1963 | Corliss | 4/317 |
| 3,553,741 | 1/1971 | Owens | 4/355 |
| 3,633,218 | 1/1972 | Lekberg | 4/317 |
| 3,673,614 | 7/1972 | Claunch | 4/317 |
| 3,829,909 | 8/1974 | Rod et al. | 4/318 |
| 3,922,730 | 12/1975 | Kemper | 4/318 |
| 3,934,275 | 1/1976 | Bishton, Jr. | 4/DIG. 11 |
| 3,972,076 | 8/1976 | Martini | 4/398 |
| 4,040,956 | 8/1977 | Selwitz | 4/318 |
| 4,070,714 | 1/1978 | Bishton et al. | 4/318 |

*Primary Examiner*—Henry K. Artis

*Attorney, Agent, or Firm*—Blakely, Sokoloff, Taylor & Zafman

[57] ABSTRACT

A waterless flush toilet system comprising at least one toilet and a gravity fed waste holding tank. The system utilizes a recirculating nonaqueous flushing fluid which is stored within the holding tank. The fluid, which is lighter than the waste material and insoluble therein, forms a stratified layer on the surface of the material. A float having a flushing fluid inlet floats within the layer of fluid, the float being suspended from the top of the tank by a flexible coiled hose which is coupled to the fluid inlet. The coiled hose contracts as the waste level in the tank rises, thereby permitting the float to remain within the flushing fluid layer regardless of the waste material level. When the toilet is flushed, an electric or air-powered pump draws a fraction of the fluid into the fluid inlet of the float, through the flexible hose and finally to the toilet. The fluid serves as a medium for transporting the waste material from the toilet to the holding tank. When the fluid is flushed into the tank, it separates from the waste material and returns to the stratified layer for reuse. The system includes a floating member which automatically prevents loss of the flushing fluid when the holding tank is drained. Two embodiments of the system are disclosed with a first embodiment system comprising a single toilet and single waste holding tank and a second embodiment system comprising a plurality of toilets coupled to a single tank.

21 Claims, 13 Drawing Figures

118
154
188
78
164
150
168
148
194
190
166
162
146
72
128
136
144
134
56
132
130
142
120
62
74
76
122
58
124
178
126
180
131
72

WATERLESS FLUSH TOILET SYSTEM

BACKGROUND OF THE INVENTION

1. Field of the Invention

This invention pertains to the field of waste disposal and, more particularly, to the field of closed cycle waterless flush toilet systems.

2. Prior Art

There are many sanitation requirements which cannot be met by conventional sanitation solutions. For example, many locations where sanitation facilities are needed do not have public sewers and cannot accommodate septic tanks because they are prohibited or impractical. Also, many such locations do not have an adequate supply of water to accommodate conventional water flush toilets.

There are existing waterless flush toilet systems that overcome many of the previously noted problems. A system manufactured by the Sarmax Corporation of Laguna Niguel, California is typical of such systems. The Sarmax system comprises one or more flush toilets connected to a main holding tank, the tank being disposed at an elevation lower than that of the toilets. A supply of a nonaqueous flushing fluid comprised of a highly refined mineral oil and various additives is stored within the holding tank. The flushing fluid is lighter than and insoluble in the waste material which is also held in the tank. The fluid, therefore, tends to collect on the surface of the waste material so as to form a stratified layer thereon. A smaller quantity of the flushing fluid is also stored in individual "water closet"-type tanks positioned above each toilet.

When a toilet is flushed, a valve in the "water closet" is opened, permitting the fluid stored therein to enter the toilet and flush away the waste material. The fluid and waste material are fed by gravity to the main holding tank where the fluid separates from the waste material and becomes part of the stratified layer. When a toilet is being flushed, flushing fluid is simultaneously drawn up from the stratified layer in the tank to replace the fluid lost from the "water closet".

A fluid pickup device is disposed within the tank which floats within the surface layer of fluid regardless of the waste level within the tank. The float includes a plurality of fluid inlets which are connected to at least one flexible hose which exits through the top of the tank. A pump is used to draw the flushing fluid up through the pickup device fluid inlets, through the hose and then to the individual "water closets."

Once the tank becomes filled, a line from a vacuum pump truck is connected to the waste outlet located at the top of the tank. A pump down tube which is connected to the waste outlet extends from the top of the tank to the tank bottom, so that waste material is drawn up from the bottom through the tube into the pump truck. Not all of the waste material is removed during pump down. When the level of the waste and the flushing fluid strata drops to a predetermined point, automatic means prevents further pumping so that none of the flushing fluid is removed.

The presently existing waterless flush toilet systems solve many sanitation problems in locations where water flush toilets are not practical. However, such prior art systems possess many shortcomings. The Sarmax system, for example, is quite complex, utilizing electronic controls and the like. Furthermore, such systems are very bulky and not suitable for many applications, such as vehicles. A system is needed which is simple and does not incorporate complicated control means. Such a system would be more reliable than prior art systems and much less expensive. Furthermore, a system is needed which is compact and can be used in locations where space is at a premium, such as in mobile homes, buses, aircraft, boats or the like.

SUMMARY OF THE INVENTION

A waterless flush toilet system is disclosed comprising at least one toilet and a gravity-fed waste holding tank. The system utilizes a recirculating nonaqueous flushing fluid which is stored within the holding tank. The fluid, which is lighter than the waste material and insoluble therein, forms a stratified layer on the surface of the material. A float having a flushing fluid inlet floats within the layer of fluid, the float being suspended from the top of the tank by a flexible coiled hose which is coupled to the fluid inlet. The coiled hose contracts as the waste level rises, thereby permitting the float to remain within the flushing fluid layer regardless of the waste material level. When the toilet is flushed, an electric or air-powered pump draws a fraction of the fluid into the fluid inlet of the float, through the flexible hose and finally to the toilet. The fluid serves as a medium for transporting the waste material from the toilet to the holding tank. When the fluid is flushed into the tank, it separates from the waste material and returns to the stratified layer for reuse.

The disclosed system also includes a novel means for preventing the loss of flushing fluid when the waste holding tank is drained. A funnel-like structure made of a perforated material is disposed within the waste holding tank. The structure has a large opening at the top which is positioned under a waste holding tank inlet located in the upper portion of the tank. The structure tapers from the large opening to a smaller opening which is positioned over the holding tank waste outlet located in the tank bottom, with the small opening being approximately the same size as the outlet. A float member having a cross-section at least as large as the waste outlet is also disposed within the waste holding tank. The float member floats near the surface of the waste material with a substantial portion of the member extending down into the material itself. When the waste outlet is opened to drain the tank, the perforated structure guides the float member to the waste outlet, as the waste level drops. The member eventually becomes seated within the outlet forming a seal and thereby preventing a small amount of waste material and the flushing fluid layer on the surface thereof from exiting the tank.

The system further includes a perforated panel member which is disposed between the fluid pickup float and the funnel-like structure. The panel member, which extends from the tank bottom to the top, prevents lateral movement of the pickup float while permitting the float to move vertically to accomodate varying waste levels. The solid phase component of the waste matter which enters the tank by way of the waste inlet is prevented from traveling to the region of the tank adjacent the flushing fluid pickup float by the perforated structure and perforated panel member. The structure and panel member combination, therefore, act as a partition which divides the interior of the tank into a solid and a liquid waste compartment. The solid waste compartment, which is near the waste inlet, contains the solid phase waste matter, a fraction of the liquid phase waste matter and a fraction of the flushing fluid. The liquid waste compartment, which includes the region of the tank where the pickup float is located, contains the remainder of the flushing fluid and liquid phase waste matter. This arrangement insures that the flushing fluid pickup float will not become clogged with solid waste matter. Furthermore, the pick-up float is located in the liquid waste compartment and is, therefore, displaced from the waste inlet located in the solid waste compartment. Thus the fluid adjacent the pickup float will not be agitated by the waste matter when it is deposited into the tank, therefore the fluid picked up by the float for flushing will be relatively free of waste matter.

Two embodiments of the novel system are disclosed. The first embodiment system utilizes a waste holding tank fed by a single toilet whereas the second embodiment system includes a single low profile tank fed by a plurality of toilets. The second embodiment system is particularly suitable for use on commercial aircraft.

DETAILED DESCRIPTION OF THE INVENTION

Figure 1:
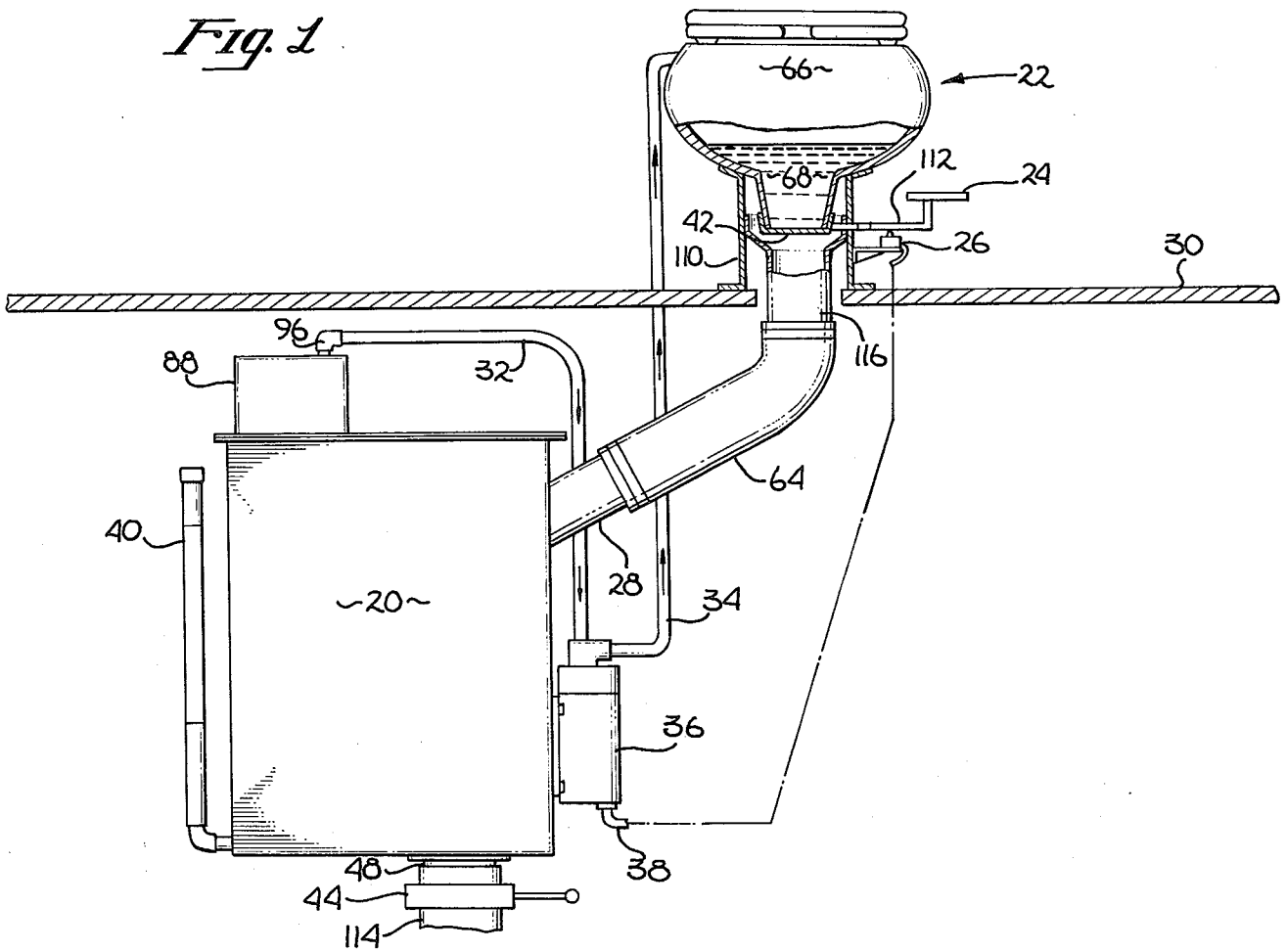
FIG. 1 is an elevational view of a first embodiment toilet system.

Referring now to the drawings, FIG. 1 shows a first embodiment of the subject invention. The invention includes a toilet generally indicated by the numeral 22. The toilet includes a toilet bowl 66, preferably made of vitreous china, although lighter weight materials such as metals or plastics may be more suitable in mobile applications. Toilet bowl 66 is ridigly secured to a substantially level surface such as floor 30 by way of a bracket 110. Bracket 110 is in turn bolted or welded or otherwise securely fastened to floor 30.

FIG. 1 also shows the details of the toilet 22 gravity flow flushing mechanism. The mechanism includes a foot-actuated flushing pedal 24 attached to a flushing valve 42 through a shaft 112. The flushing valve 42 is a normally-closed valve similar to those used in conventional portable toilets. Such valves, which are well-known in the art, typically include a generally circular-shaped plate (not shown) which sealably engages the bowl outlet. When the bowl is flushed by depressing pedal 24, the plate rotates about a horizontal shaft (not shown), thereby permitting the contents of the bowl to exit through the bowl outlet. The plate generally rotates in a rapid, snap-action manner to facilitate the flushing process.

A flushing fluid, to be described in greater detail below, is supplied to the toilet 22 by way of flushing fluid inlet line 34. The fluid is distributed around the upper periphery of the bowl 66 by a channel (not shown) formed in the bowl and is discharged into the bowl through a series of spaced-apart openings or jets. The openings preferably direct the flushing fluid into the bowl at an angle so as to generate a swirling action which enhances the flushing process.

FIG. 1 also shows the system holding tank 20. The tank serves the two-fold purpose of storing the waste material and also separating the flushing fluid from such material. Tank 20 is preferably made of stainless steel, although other materials may be substituted. Any size tank may be used, with tanks having a capacity in the range of 20 to 25 gallons having been found suitable in applications on buses traveling long-distance routes. The tank 20 must be located at an elevation below that of toilet 22. The waste material and flushing fluid are conducted from toilet 22 to the tank by way of a toilet exit pipe 116 attached to the toilet which extends through an opening in floor 30. Pipe 116 is coupled to an elbow 64 which is in turn coupled to waste inlet line 28 which passes through the holding tank wall. The various pipes should be sloped downwardly from the toilet to the tank at approximately ½" per foot to ensure adequate gravity flow. Elbow 64 can be made of a flexible material to permit greater flexibility in mounting the tank and toilet.

Figure 2:
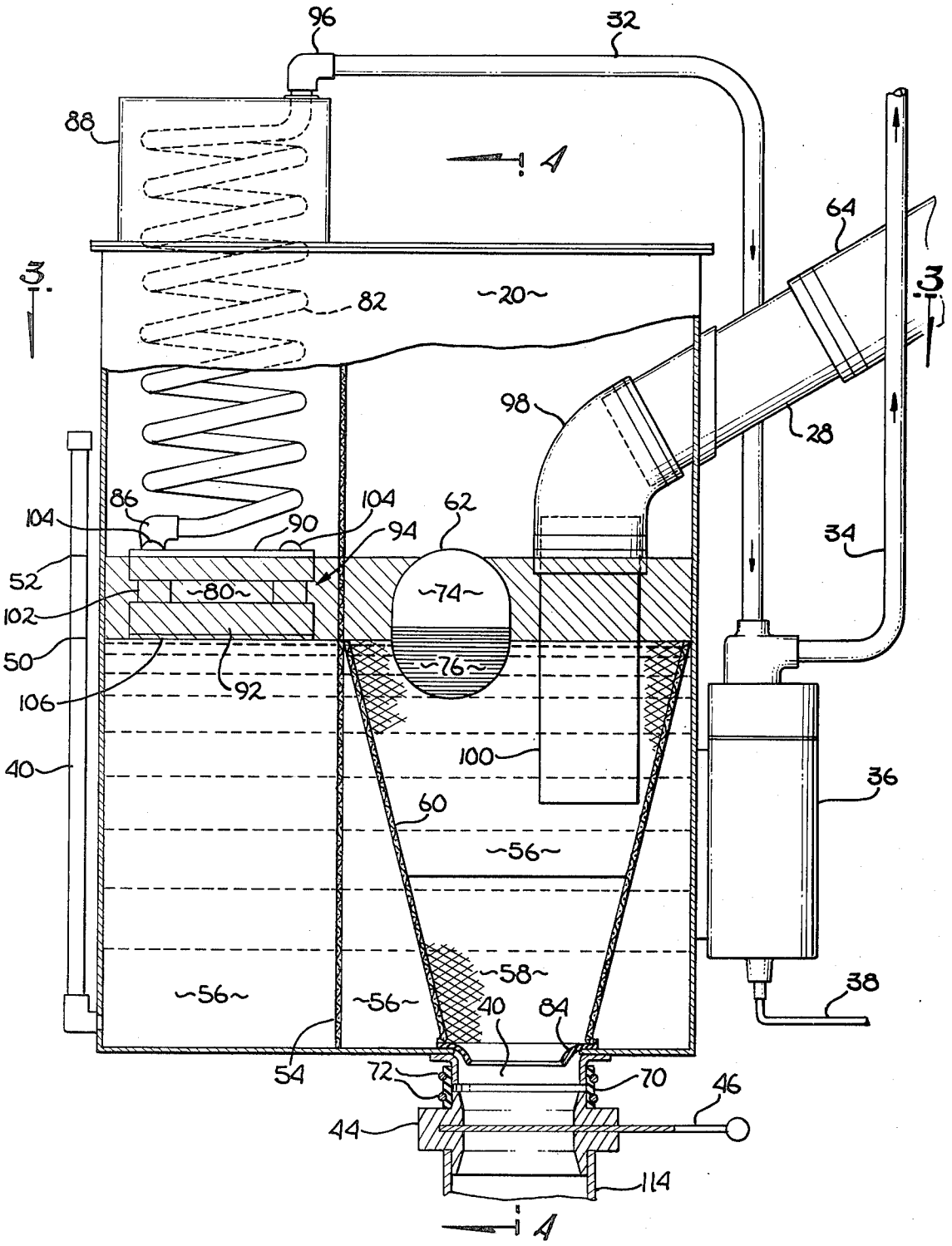
FIG. 2 is a partial cross-sectional view of the first embodiment system waste holding tank.
Figure 3:
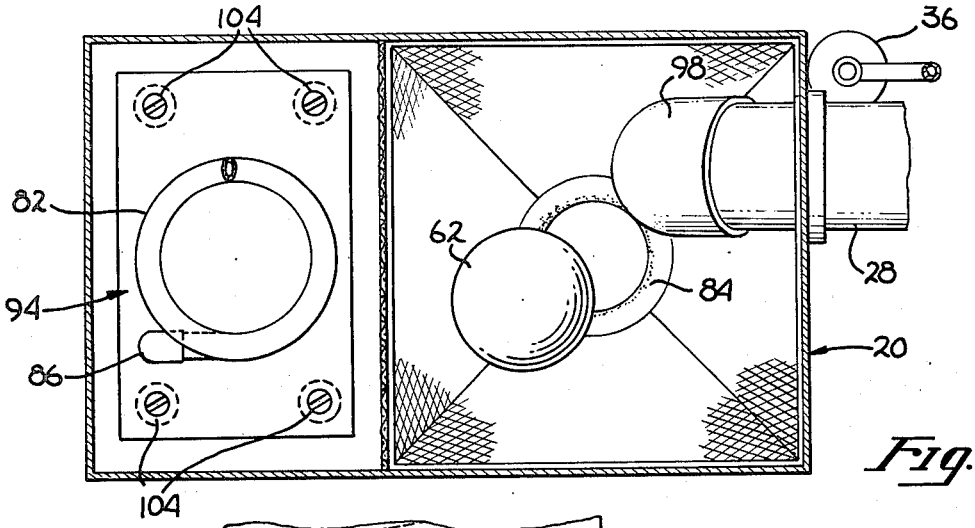
FIG. 3 is a cross-sectional view of the first embodiment waste holding tank taken along line 3—3 of FIG. 2.
Figure 4:
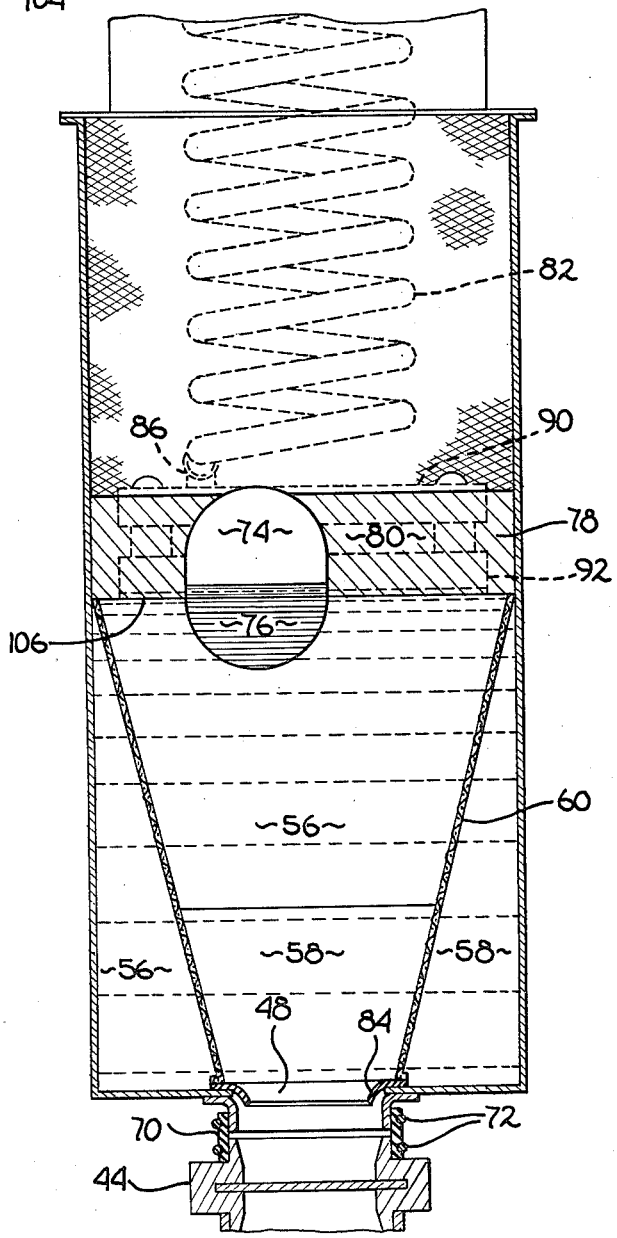
FIG. 4 is a cross-sectional view of the first embodiment wast holding tank taken along line 4—4 of FIG. 2.

Referring now to FIG. 2, the details of the first embodiment holding tank 20 may be seen. The tank receives the flushing fluid and waste material from the toilet from inlet line 28 mounted through the tank wall. The fluid and waste material enter the tank through an extention pipe 100 coupled to the inlet line 28 by way of elbow 98. A funnel-like screen 60 made of perforated metal is positioned within the holding tank immediately below waste inlet line 28. The screen 60 is comprised of four trapezoidal-shaped sections connected together to form the sides of a truncated pyramid. The upper ends of three of the screen sections are fastened to the walls of tank 20 with the upper end of the fourth section being attached to a perforated panel member 54. The lower ends of the screen section, which are secured to the bottom of the waste holding tank, define a lower opening in screen 60 which coincides with a holding tank waste outlet 48. Each of the four sections of the screen 60 are preferably offset from vertical by approximately 15 degrees.

Panel member 54, which is adjacent screen 60, extends across the width of the tank, and from the tank bottom to the top of the tank. Panel member 54 and screen 60 are both preferably fabricated from perforated metal sheets having ⅛-inch openings staggered every 3/16 inch so as to provide an open area of approximately 41% of the total area of the screen. The perforations in screen 60 and panel member 54 permit the liquid phase of the waste material 56 and flushing fluid 78 to pass therethrough while impeding the transfer of the solid phase waste material 58.

When the waste matter and flushing fluid arrive from the waste inlet 28, screen 60 and that portion of panel member 54 disposed above screen 60, prevent the solid waste 58 from entering the region of the tank opposite the waste inlet. It can be seen, therefore, that screen 60 in combination with panel member 54 act as a partition which divides the tank into a solid waste and a liquid waste compartment, with all of the solid phase matter 58 and a fraction of the liquid phase matter 56 and flushing fluid 78 being disposed in the solid waste compartment and the remainder of the liquid phase matter and flushing fluid being disposed in the liquid waste compartment.

The subject invention utilizes a recirculating fluid 78 for a flushing medium rather than water. Such fluids are well known in the sanitation art. The nonaqueous flushing fluid 78 is a hydrophobic substance, somewhat lighter than water, water, having a specific gravity in the range of approximately 0.8. having a specific gravity in the range of approximately 0.8. As shown in FIG. 2, the fluid 78 separates from the waste material and will not mix with either the solid phase waste 58 or the liquid phase 56. A flushing fluid comprised of a blend of highly refined mineral oil and various additives such as deodorizers, dyes and microbiocides has been found to be ideal, although other substances such as unscented kerosene can be used instead of mineral oil in emergencies.

The flushing fluid 78 travels through a closed-loop path. When the toilet 22 is flushed, the fluid acts as a carrier for transporting the waste matter with the aid of gravity from the toilet to the holding tank 20. It is necessary, therefore, to retrieve the flushing fluid from the tank 20 so that it can be reused in subsequent flushings. As can best be seen in FIG. 2, the material that enters the storage tank quickly separates into various components with the solid phase 58 of the waste material being deposited within screen 60 directly over tank waste outlet 48 and a fraction of the liquid phase material and flushing fluid passing through the screen 60 into the remainder of the tank. As previously noted, the lightweight flushing fluid will not mix with the waste material, but will instead rise to the surface of the material so as to form a stratified layer 78 of fluid. The quantity of fluid present is preferably such that a 2 to 3 inch layer is formed.

The subject system includes a flushing fluid pickup float 94 disposed within the fluid layer 78 in the liquid waste compartment which is used for retrieving the fluid from the tank. FIGS. 2, 3, 4 and 6 show the details of the pickup float 94 which includes two rectangular-shaped sections 90 and 92. The sections are separated by four spacers 102 so as to form a space or plenum 80 between the sections. Plenum 80 is preferably ⅝ inch thick. Four bolts 104 are used to secure the float sections 90 and 92 together.

Figure 6:
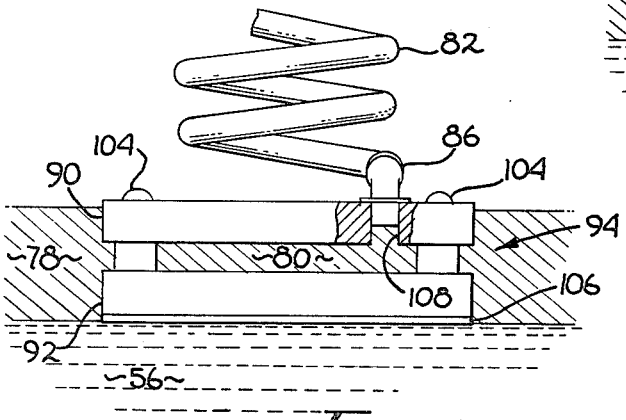
FIG. 6 is a fragmentary view of the flushing fluid pickup float.

As can best be seen in FIG. 6, an opening 108 is formed in the upper float section 90. One end of an elbow 86 is secured within the opening with the other end being attached to a coiled hose 82. The opposite end of hose 82 is attached to a second elbow 96 mounted on the upper surface of a housing 88. The input of a pump 36 which is mounted on the side of tank 20 is connected to the other end of elbow 96 through a fluid line 32. The output of the pump 36 is in turn connected to toilet 66 through a fluid line 34. Electric pumps of either the A.C. or D.C. voltage variety can be used, with A.C. pumps being preferred in locations where A.C. power is available and D.C. powered pumps being preferred in mobile applications where A.C. power is usually not available. Pump 36 may also be an air pump which is powered by compressed air. Air pumps, which are well known in the art, are particularly suitable on large vehicles such as buses which utilize compressed air for braking purposes.

A pump switch 26, which is mounted on the toilet mounting bracket 110 immediately below shaft 112, is used for actuating pump 36 through line 38. If pump 36 is an electric pump, switch 26 is an electric switch and line 38 is one or more electric wires. If pump 36 operates on compressed air, switch 26 is a conventional air switch and line 38 is an air line connecting a compressed air supply (not shown) to the pump.

When toilet 66 is flushed by depressing flush pedal 24, flushing valve 42 opens and switch 26 is activated, causing pump 36 to be energized. Flushing fluid is then pumped from plenum 80 of the pickup float into opening 108 in the upper float section 90, through coiled hose 82 and then delivered to the toilet bowl 22 by lines 32 and 34. When flushing is completed, flushing valve 42 closes and switch 26 is deactivated, causing delivery of the fluid to the bowl 66 to cease. However, pump 36 continues to pump for a short period following deenergization and delivers a small amount of fluid 68 which remains in bowl 66.

Float 94 remains suspended in the flushing fluid strata 78 regardless of the amount of waste contained in the tank. When the waste level is low, the pickup float 94 is disposed near the lower section of tank 22, thereby causing the coiled hose 82 to expand. As the waste level increases, float 94 rises, permitting coiled hose 82 to contract. A housing 88 is constructed in the tank 22 top over the float to receive the contracted hose when the tank is almost filled. As can best be seen in FIG. 3, the walls of tank 20 and panel member 54 limit lateral movement of float 94 so that the float is always properly positioned below housing 88.

For satisfactory operation of the system, it is important that the fluid delivered to the bowl contain no waste matter. The present system incorporates many features which insure that only flushing fluid is delivered. One common problem encountered in prior art waterless toilets is the presence of toilet paper or other paper products in the tank. Paper is light and will often float on the surface of the waste material within the fluid strata, thereby causing the fluid intake opening 108 eventually to clog. This problem is avoided in the present system since panel member 54 prevents any solid matter such as paper from passing into the liquid phase compartment of the tank where pickup float 94 is disposed.

In order to avoid pickup up any of the liquid wastes 56, it is important that the float 94 be centered in the strata of flushing fluid 78. The weight of the float 94 and therefore the density can be adjusted by means of a weight plate 106 attached to the bottom surface of lower float section 92. The weight plate 106 is preferably a metal such as stainless steel or steel with a suitable coating (e.g., plastic) to prevent corrosion. Weight plate 106 also compensates for the upward force created by the contraction of coiled hose 82. Obviously, the upward force created by the hose when the waste level in the tank is relatively low and the coiled hose 82 expanded is greater than the force exerted when the tank is full and the hose contracted. In order to minimize the effect of the change in force which causes the float 94 to change its position within the fluid strata 78, coiled hose 82 should be constructed in a manner such that the change in force will be small. This can be accomplished by constructing a coiled hose which exerts a relatively small force so that the change in force will accordingly be small. A coiled hose made of a relatively inflexible tubing which is long relative to the required displacement of the float is ideal. The length of the tubing can be confined to a relatively small volume by employing several turns, each of which is large in diameter, as shown in FIG. 2. It has been found that a suitable coiled hose can be made from polyethylene tubing which is heated and then coiled around an appropriately shaped mandrel to create the spring-like shape. Once formed in this fashion, the polyethylene retains in its "memory" the shape of the mandrel and as such acts as a spring which, when extended, tends to contract. The contracting force offsets the weight of the coiled hose when the hose is filled with flushing fluid. This novel feature thus provides, in effect, a very low rate spring which is ideal for use in the flushing fluid pickup mechanism.

Agitation of the material in the tank 22 has a tendency to cause some of the waste material to become temporarily mixed with the flushing fluid layer 78. Such agitation occurs when toilet 60 is flushing both because of the material entering the tank from the extension 100 and the small quantity of fluid being taken up for flushing purposes. Similarly, agitation will occur in mobile applications when the vehicle is under way. The effects of agitation caused by material entering the tank through extension 100 is minimized by disposing the pickup float 94 and the extension on opposite sides of the tank. Furthermore, float 94 serves to dampen the motion of the flushing fluid in the vicinity of the float so that there will be a lesser tendency for the fluid and waste to mix at that point. Also, the plenum 80 from which the fluid is drawn is shielded by upper and lower float sections 90 and 92, therefore, the fluid used for flushing is freer of foreign substances and is less agitated than the fluid outside the plenum. In any event, there will invariably be a small quantity of waste material mixed with the flushing fluid and vice-versa. The waste material which mixes with the fluid in the fluid strata will tend to form an emulsion. The presence of the emulsion, however, does not adversely affect the flushing capabilities of the system due, in part, to the fact that the solid phase waste matter is prevented from entering the liquid waste compartment where the pickup float 94 is located.

The level of waste material in tank 20 can be determined by viewing a transparent sight gage 40 attached to the lower section of the tank. The gage permits not only the waste level 50 to be determined but also the flushing fluid level 52. When the tank is full, a discharge hose from either a vacuum pump truck, a larger stationary holding tank or a sewer line is connected to the waste outlet 114 of a slide valve 44. Slide valve 44 is connected to outlet 48 by a sleeve 70 made of flexible material such as nitrile rubber. Two hose clamps 72 are used to secure the sleeve 70 to the tank outlet 48 and the slide valve 44 inlet. Slide valve 44 is manually operated by means of handle 46. When the valve 44 is opened by pulling handle 46 outwardly, the waste material exits the tank. The solid phase waste material 58 is positioned directly over the outlet 48; therefore, this material exits the tank first, followed by the liquid phase matter 56. This sequence is advantageous since the liquid phase matter 56 acts as a flushing agent which tends to thoroughly flush the solid phase matter from the tank while also backflushing screen 60 and panel member 54.

Figure 7:
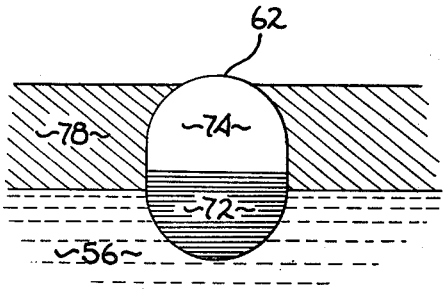
FIG. 7 is a fragmentary view of the float member.

Flushing fluid 78 is used repeatedly, therefore the fluid is normally retained when the tank is flushed. This may be accomplished by observing the sight gage 40 and shutting off slide valve 44 when the waste level 50 approaches the bottom of the gage. This process is somewhat cumbersome and requires the close attention of the operator. More importantly, it is sometimes not possible to mount the gage 40 where it can be observed by the operator. For example, in some mobile applications, the gage is mounted in the interior of the vehicle, while the slide valve 44 is operated from outside. The present invention includes a novel means whereby the flushing fluid is automatically retained when tank 20 is emptied. This novel means includes a drain float 62 which is disposed within screen 60. As can best be seen in FIG. 7, float 62 is comprised of a nylon lower section 72 having a circular cross section and a lighter weight upper section 74 which provides buoyancy. Upper section 74 can be made of wood, closed cell-foam, or a silicone foam material (e.g., SILASTIC-RTV Silicone made by General Electri) filled with glass or plastic microspheres or microballoons to obtain the desired density. The upper 90 and lower 92 portions of float 94 can also be made of the same materials. While the float 62 is shown as a two-piece float, it is possible to utilize a onepiece float which has been properly shaped and has the desired buoyancy characteristics and chemical compatibility with the materials used. The weight and volume of float 62 is adjusted so that the nylon section 76 extends a substantial distance into the liquid phase waste 56.

Figure 5:
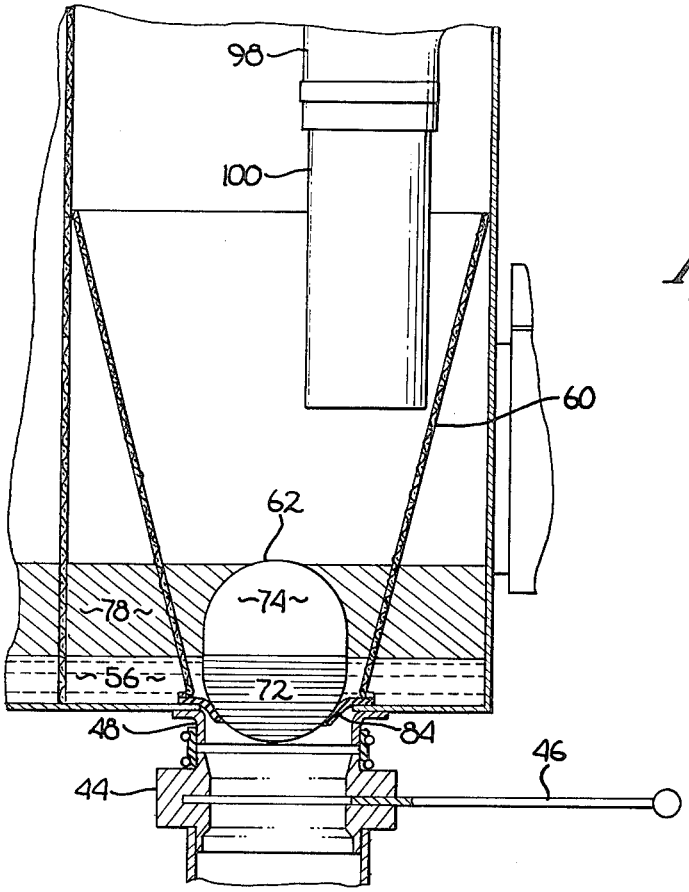
FIG. 5 is a fragmentary side view of the first embodiment waste holding tank showing the tank emptied except for the flushing fluid and a small quantity of waste material, both of which are retained therein by virtue of the float member being seated within the waste outlet.

A flexible lip 84 is disposed between the lower portion of screen 60 around the entire inner periphery of the tank waste outlet 48. The lip 84, which is preferably made of nitrile rubber, although other suitable flexible materials could be used, extends a substantial distance into the waste outlet 48 opening. When slide valve 44 is opened, the waste material is free to exit through the waste outlet. As the level of waste becomes lower, float 62 is guided towards the outlet by screen 60. When the waste level approaches the level shown in FIG. 5, the lower nylon section 76 of float 62 come into contact with lip 84 and become seated within the outlet opening, thereby effecting a seal. Since the solid phase waste 58 exits the tank initially, none of this waste is present to interfere with the seal. As can be seen in FIG. 5, outlet 48 is closed with a small quantity of liquid phase waste 56 material remaining in the tank in order to ensure that none of the flushing fluid 78 is lost. Slide valve 44 is then closed and the system is ready for use again. It can be seen, therefore, that float 62 serves as a waste level detector which detects the level of the waste material in the tank and seals the outlet automatically when the waste level drops to the desired level.

A second embodiment waterless flush toilet system may be seen in FIGS. 8 through 13. The second embodiment system is adapted to be used on an aircraft or the like and includes a plurality of individual toilets 118 feeding a common waste holding tank 120. Waste holding tank 120, which is fabricated from a lightweight material such as aluminum, is a substantially cylindrically-shaped vessel which is preferably positioned in an aircraft with the major axis of the tank parallel to the aircraft fuselage. Toilets 118, which are located in separate adjacent toilet compartments, would normally be positioned within the aircraft at right angles to the fuselage, but are shown in FIG. 1 rotated 90° for the purpose of illustration.

Figures 9, 11:
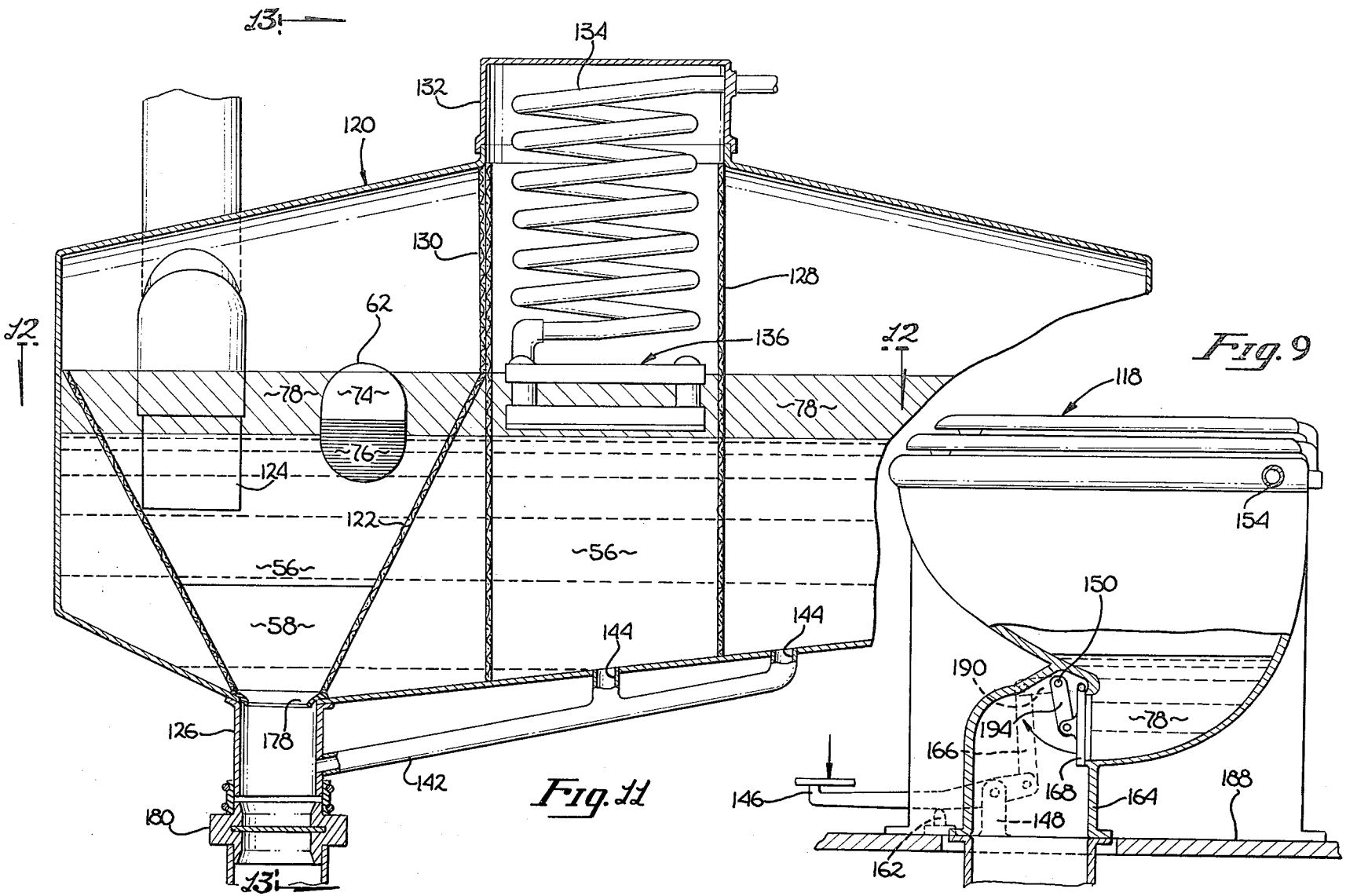
FIG. 9 is a partial cross-sectional side view of the toilet used in the second embodiment system taken substantially through line 9—9 of FIG. 8.
FIG. 11 is a fragmentary cross-sectional side view of the second embodiment system waste holding tank taken substantially through line 11—11 of FIG. 10.
Figure 12:
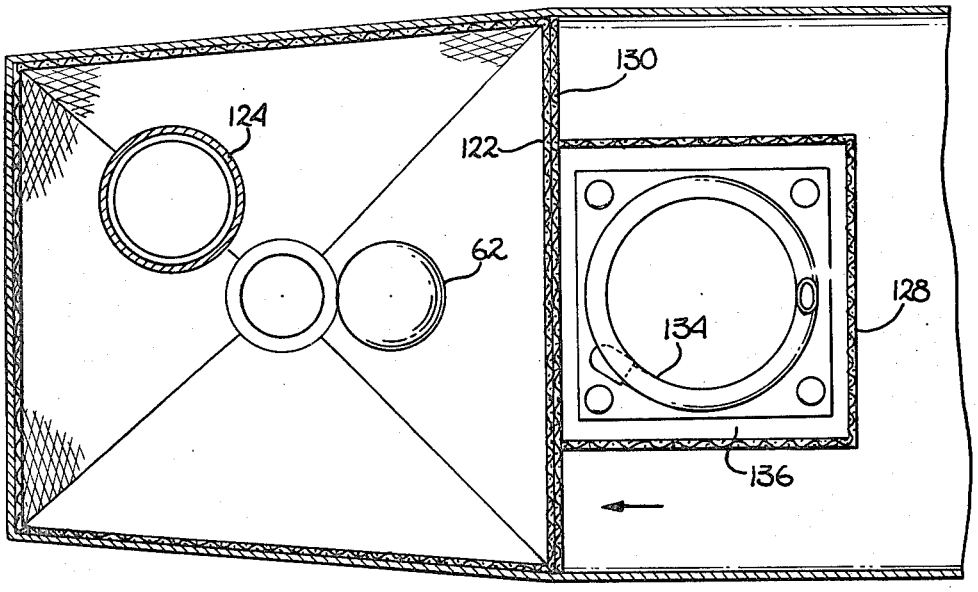
FIG. 12 is a fragmentary cross-sectional plan view of the second embodiment system waste holding tank taken substantially through line 12—12 of FIG. 11.
Figure 13:
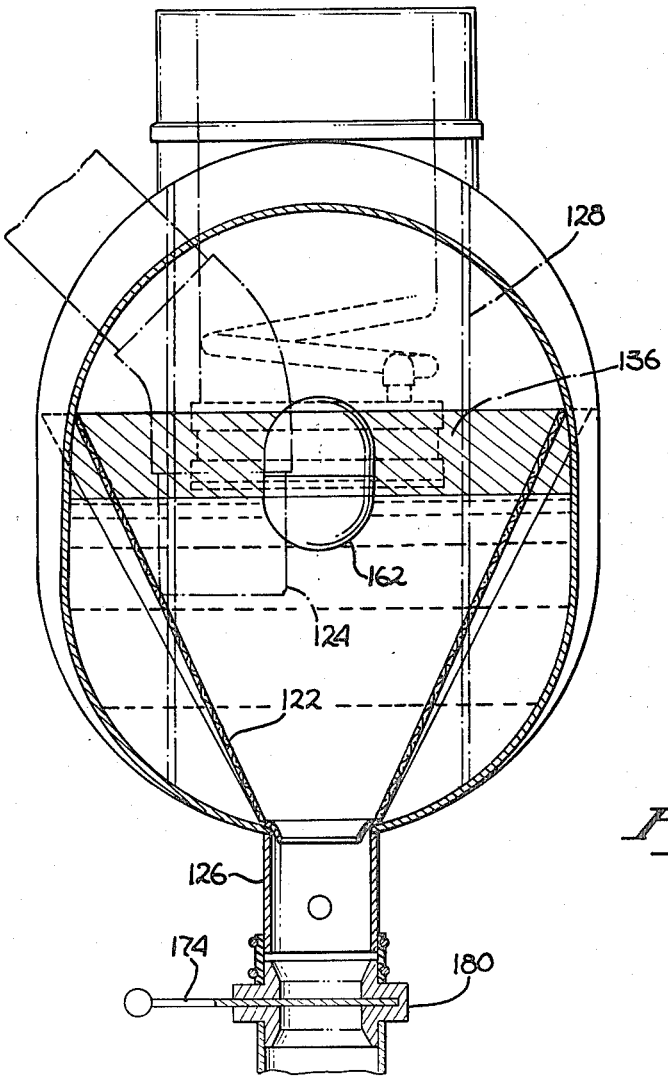
FIG. 13 is a cross-section end view of the second embodiment system waste holding tank taken substantially through line 13—13 of FIG. 11.

As can best be seen in FIG. 11, the second embodiment waste holding tank 120 includes a waste inlet 124 located at an extreme end of the interior of the tank and a funnel-like screen 122 made of perforated metal disposed therebelow which is similar to screen 60 of the first embodiment system. A drain float 62 is provided for engaging the seal 178 disposed at the waste outlet 126 when the tank is drained by opening slide valve 180.

A flushing fluid pickup float 136, coupled to a polyethylene coiled hose 134, is located in the central region of the tank 120. A float housing 128 made of perforated metal is used to prevent lateral movement of the float. Housing 128 extends from the bottom of the tank to the tank top and, as can best be seen in FIG. 12, has a rectangular-shaped cross-section which is slightly larger than that of the pickup float so that the float is free to move vertically as the waste level changes. A perforated metal panel member 130 is located adjacent float housing 128 immediately above screen member 122 which cooperates with the screen member to form a partition which divides the tank into solid and liquid waste compartments. The solid waste compartment, which is located on the waste inlet side of panel member 130, holds the solid waste matter 58, a fraction of the liquid phase waste 56, and a fraction of the flushing fluid 56. The remainder of the tank, including the region adjacent the float housing 128, comprises the liquid waste compartment which contains the remainder of the liquid phase waste matter and the flushing fluid. Perforated panel member 130 and screen 120 impede the transfer of the solid phase waste matter to the liquid waste compartment. Panel member 130 and screen member 122 further prevent the drain float 62 from entering the liquid waste compartment.

Flushing fluid 78 is delivered to the toilets 118 by way of electric pump 176 which is activated when one or more of the toilets are flushed. A main flushing fluid line 156 is coupled to a plurality of separate fluid lines 154 which carry the fluid to the individual toilets 118. A check valve 138 is coupled in series with the main line 156 so that the individual lines 154 and the distribution line 156 will remain charged with fluid. This feature insures that flushing fluid will be available for flushing immediately upon activation of pump 176.

Each of the individual fluid lines 154 is provided with a series-coupled solenoid valve 152 which is normally closed. When a toilet flush pedal 146 of a toilet 118 is depressed, an electric switch 162 closure occurs causes pump 176 to be activated along with the corresponding normally closed solenoid valve 152. So long as flush pedal 146 is depressed, flushing fluid will be delivered to the appropriate toilet through main fluid line 156, the corresponding solenoid valve 152 and fluid line 154. The normally closed solenoid valves 152 on the remaining toilets will prevent such toilets from receiving any of the pumped fluid. Pump 176 has a sufficient pumping capacity to permit all of the toilets to be flushed simultaneously. Of course, the quantity of flushing fluid 78 disposed in the waste holding tank 120 should be large enough to accomodate all of the toilets.

Figures 8, 10:
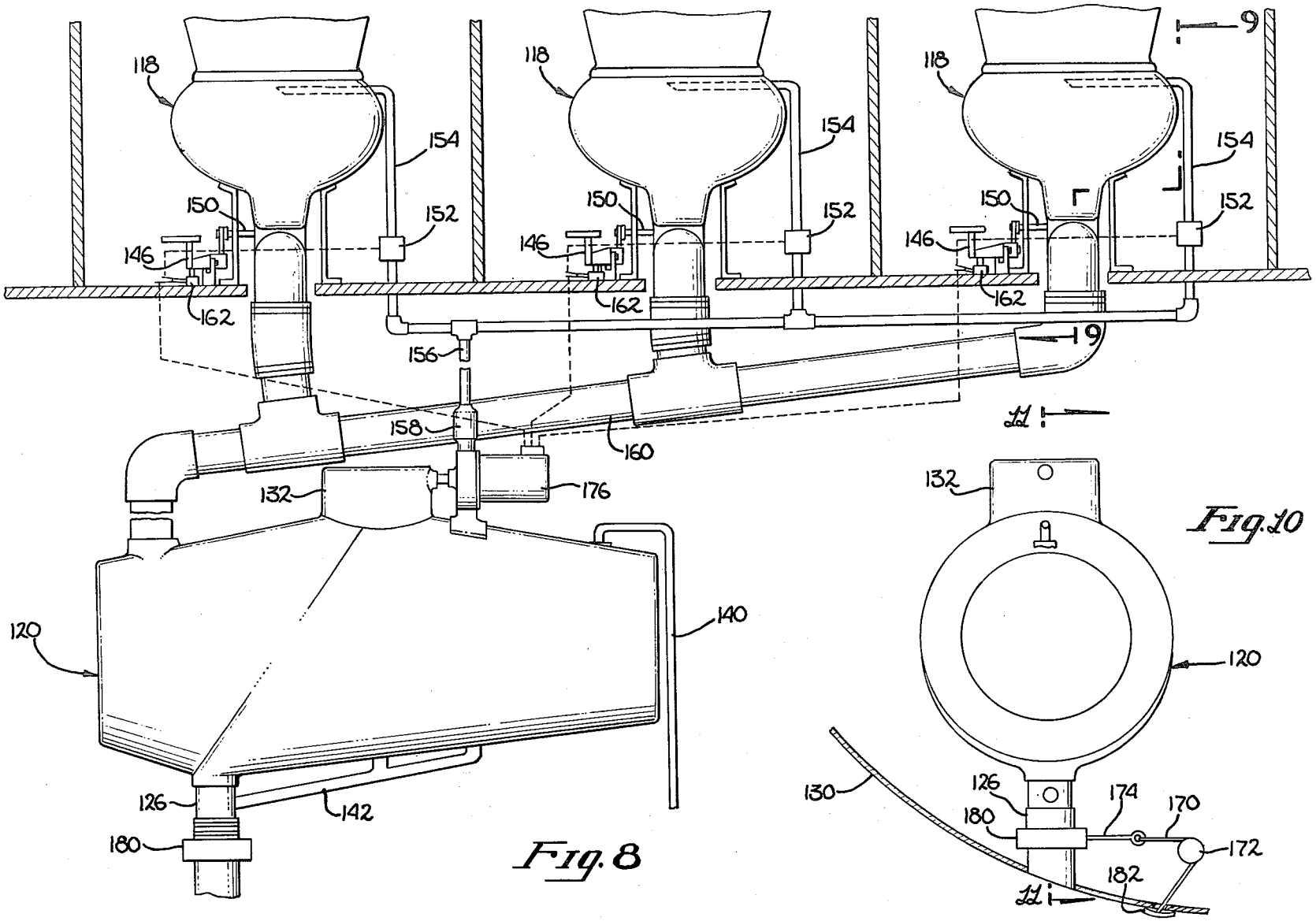
FIG. 8 is a elevational view of a second embodiment system for use on an aircraft which utilizes a plurality of toliets feeding a single waste holding tank.
FIG. 10 is an end view of the second embodiment system waste holding tank.

The details on the individual toilets 118 may be seen in FIGS. 8 and 9. The toilets are of stainless-steel construction and are each provided with a manually operated flushing valve 168 which is normally closed. Flush pedal 146 is pivotally mounted on member 148 which is secured to the aircraft floor 188. Pedal 146 is coupled to one end of a rotatably mounted horizontal shaft 150 by way of linkages 166 and 190. The opposite end of shaft 150 is pivotally attached to flushing valve 168 by a third linkage 194. When pedal 146 is pressed downward, linkage 166 coupled to the pedal will move upwards thereby causing linkage 190 to rotate shaft 150 in a clock-wise direction (FIG. 9). The rotation of shaft 150 causes the hinged flushing valve 168, which is coupled to the shaft of by way of linkage 194, to swing away from the toilet outlet 192 thereby permitting waste matter and accompanying flushing fluid to exit the toilet through elbow 164 and travel to the holding tank waste inlet 124 by way of a main sloping waste line 160. As previously noted, the depression of flush pedal 146 also activates switch 162 so that flushing fluid is continuously delivered to the toilet when flushing valve 168 is open. When pedal 146 is released the flushing valve 168 will return to its normally closed position. A delay circuit (not shown) causes pump 176 and the solenoid valve 152 to remain on a short period of time following the closure of the flush valve 168 so that a small quantity of flushing fluid 78 will be delivered to the toilet and remain there until the toilet is reused. It should be noted that the flushing valves 168 serve a secondary purpose of preventing waste matter from the holding tank 120 from entering the toilets through elbows 164 when the aircraft experiences large accelerations.

The waste holding tank 120 is periodically drained by opening slide valve 180. This may be accomplished, as shown in FIG. 10, by pulling a handle 82 which is located outside of the aircraft fuselage 138. Handle 182 is coupled to a slide valve operating member 174 by way of cable 170 which passes over a pulley 172. When the handle is pulled, cable 170 opens slide valve 180 thereby permitting the tank to be drained into a larger holding tank or a sewer line (not shown) which is coupled to the slide valve outlet. As can be seen in FIG. 11, the bottom surfaces of the tank slope downwardly towards to waste outlet 126 so that the tank will drain rapidly. One or more supplementary waste outlets 144 are disposed along the bottom of the tank 120. The supplementary outlets 144, which fed the main waste outlet 126 by way of drain line 142, promote the drainage of the fine solid waste matter which has passed through screen 122 and panel member 130 into the liquid waste compartment where such matter tends to adhere to the bottom of the tank. The drain float 62 prevents the flushing fluid from escaping the waste holding tank 120 in the same manner as previously discussed regarding the first embodiment system. When it becomes necessary to replace the flushing fluid, the tank can be completely emptied and the interior rinsed with the water using a rinse line 140 attached to the upper portion of the tank.

The second embodiment waste holding tank 120 has a relatively low profile when compared to that of the first embodiment tank. This feature serves two purposes. First, the low profile tank 120 can be readily installed within an aircraft fuselage where space is of a premium. Second, the low profile shape renders the toilet system relatively immune to the large accelerations often encountered by an aircraft in flight. As noted previously regarding the first embodiment system, agitation of the liquid and solid phase waste matter has some tendency to cause the matter to mix with the flushing fluid strata 78. When the tank is subjected to accelerations, especially accelerations in the horizontal plane, the maximum agitation and displacement of the contents of the tank will occur where the waste matter and fluid impinge of the tank walls. This phenomina is commonly called cinching. There will be a minimum amount of cinching or displacement of the holding tank contents at the central portion of the tank which is the region furthest removed from the tank walls. As can be seen in the drawings, the perforated float housing 128 is positioned in the central region of the tank where the flushing fluid strata 78 experiences the least amount of agitation and displacement. Furthermore, the low profile shape of tank 120 enables the pickup float 136 to be displaced a relatively large distance from the walls of the tank for a given tank volume. The fluid picked up by float 136 will, therefore, be relatively free of waste matter even when the aircraft is experiencing air turbulence or the like.

There has been described herein two embodiments of a novel waterless flush toilet system which is of simple construction and which provides trouble-free operation. It is to be understood, however, that while one specific embodiment of the present invention has been disclosed and described in detail herein, various changes in form and detail could be made by those skilled in the art without departing from the spirit and scope of the invention.

What is claimed is:

1. In a waterless flushing toilet system including at least one toilet, a waste holding tank having a waste inlet and a waste outlet, a supply of a nonaqueous flushing fluid stored in said holding tank, said fluid being lighter than and substantially insoluble in water, so that a stratified layer of said fluid is formed on the upper surface of the waste material held in the tank and a flushing fluid pickup device disposed in said tank for removing a quantity of flushing fluid from said tank to be delivered to said at least one toilet for flushing purposes, an improvement comprising:

a perforated position disposed in said tank which divides said tank into a solid waste and a liquid waste compartment with said waste inlet and outlet being disposed in said solid waste compartment and said fluid pickup device being disposed in said liquid waste compartment;

wherein said flushing fluid pickup device is a pickup float which floats within said liquid waste compartment, said float comprising an upper pickup float member and a lower pickup float member coupled to and spaced apart from said upper member, said upper and lower members defining a plenum containing flushing fluid with at least one flushing fluid inlet being disposed in said plenum; and a hose having a first end coupled to said pickup float and in communication with said at least one flushing fluid inlet and a second end coupled to a means for supplying said flushing fluid to said at least one toilet, said hose being substantially in the form of a coil with said pickup float being suspended by said hose;

whereby solid and liquid phase waste arriving from said at least one toilet through said waste inlet is deposited in said solid waste compartment with said partition impeding the transfer of the solid phase waste from said solid waste compartment to said liquid waste compartment where said flushing fluid is picked up by said float member and delivered to said at least one toilet through said hose.

2. The improvement of claim 1 further including:

detecting means for detecting the level of waste material in said holding tank;

stopping means responsive to said detecting means for stopping flow through said waste outlet;

whereby when said waste outlet is opened for draining said holding tank, said detecting means causes said stopping means to stop the flow of waste material through said outlet prior to said flushing fluid exiting said tank.

3. The improvement of claim 2 wherein said detecting means comprises a float disposed within said tank, said float having a density less than that of water.

4. The improvement of claim 2, wherein said detecting and said stopping means comprises:

a float member disposed in said solid waste compartment, said float member having a density such that said float member normally floats approximately near the surface of the waste material and has a cross-section at least as large as said waste outlet;

whereby when said waste outlet is opened for draining said tank, said floating member approaches said waste outlet and eventually becomes seated within said waste outlet so as to form a seal and thereby prevent the loss of said flushing fluid disposed on the upper surface of the waste material.

5. The improvement of claim 4 wherein a flexible lip is disposed around an inner periphery of said waste outlet which improves the seal when said float member becomes seated within said waste outlet.

6. The improvement of claim 4 further comprising guide means coupled to said tank for guiding said float member to said waste outlet when said tank drains.

7. The improvement of claim 6 wherein said guide means is a funnel-like structure made of a perforated material, said structure defining an upper opening and tapering from said upper opening to define a lower opening, said lower opening being positioned over and approximately the same size as said waste outlet and said upper opening being positioned below said waste inlet whereby the solid phase waste matter arriving from said waste inlet tends to collect over said waste outlet, and when said tank is drained said float member is guided to said waste outlet by said structure.

8. The improvement of claim 1 wherein said hose acts as a spring and said pickup float further includes a weight coupled to said pickup float for counteracting a contraction force created by said hose.

9. The improvement of claim 1 wherein said means for supplying said flushing fluid to said at least one toilet comprises:

a pump having a pump inlet coupled to said second end of said hose and a pump outlet coupled to said toilet.

10. The improvement of claim 9 wherein said at least one toilet includes a manually-actuated flushing means for flushing said toilet and said pump in an electric pump which is responsive to said flushing means.

11. The improvement of claim 9 wherein said toilet includes a manually-actuated flushing means for flushing said toilet and said pump is an air-driven pump which is responsive to said flushing means.

12. In a waterless flush toilet system including a toilet, a waste holding tank having a waste inlet and a waste outlet, a supply of a nonaqueous flushing fluid stored in said holding tank, said fluid being lighter than and substantially insoluble in water so that a stratified layer of fluid is formed on the upper surface of waste material held in the tank, and a flushing fluid pickup device disposed in said tank for flushing purposes, an improvement comprising:

a float member disposed within said holding tank, said float member having a density such that said member normally floats approximately near the surface of the waste material and has a cross-section at least as large as said waste outlet;

wherein said pickup device is a pickup float disposed within said tank, said pickup float having at least one flushing fluid inlet disposed within said layer of flushing fluid and a hose substantially in the form of a coil having a first end coupled to said pickup float and in communication with said at least one fluid inlet and a second end coupled to a means for supplying said flushing fluid to said toilet, with said pickup float being suspended by said hose;

a perforated portion disposed within said tank which divides said tank into a solid waste compartment and a liquid waste compartment with said waste inlet, said waste outlet and said float member being disposed within said solid compartment and with said pickup float being disposed in said liquid waste compartment and is suspended by said hose with said hose being substantially in the form of a coil;

a funnel-like structure made of a perforated material disposed within said solid waste compartment, said structure defining an upper opening positioned below said waste inlet, said structure tapering from upper opening to define a lower opening, said lower opening being disposed over and approximately the same size as said waste outlet;

whereby when said waste outlet is opened for draining said tank, said float member is guided to said waste outlet by said structure and eventually becomes seated within said waste outlet so as to form a seal and thereby preventing the loss of said flushing fluid disposed on the upper surface of the waste material.

13. The improvement of claim 12 wherein said pickup float comprises:

an upper pickup float member;

a lower pickup float member coupled to and spaced-apart from said upper member, said upper and lower members defining a plenum containing flushing fluid with said at least one flushing fluid inlet being disposed in said plenum; and wherein said means for supplying said flushing fluid to said toilet comprises a pump having a pump inlet coupled to said second end of said hose and a pump outlet coupled to said toilet, said pump being respective to a manually-actuated flushing means, and said flushing means being a means for flushing said toilet, whereby said quantity of said flushing fluid which is supplied to said toilet for flushing is drawn from said fluid which is within said plenum, said fluid being supplied in response to said manually-actuated flushing means.

14. In a waterless flushing toilet system including at least one toilet, a waste holding tank having a waste inlet and a waste outlet, a supply of a nonaqueous flushing fluid stored in said holding tank, said fluid being lighter than and substantially insoluable in water, so that a stratified layer of said fluid is formed on the upper surface of the waste material held in the tank and a flushing fluid pickup device disposed in said tank for removing a quantity of flushing fluid from said tank to be delivered to said at least one toilet for flushing purposes, an improvement comprising:

a perforated partition disposed in said tank which divides said tank into a solid waste and a liquid waste compartment with said waste inlet and outlet being disposed in said solid waste compartment and said fluid pickup device being disposed in said liquid waste compartment;

retaining means for preventing said flushing fluid from exiting said holding tank when said tank is drained, said retaining means comprising a float member disposed in said solid waste compartment, said float member having a density such that said float member normally floats approximately near the surface of the waste material and has a cross-section at least as large as said waste outlet;

whereby when said waste outlet is opened for draining said tank, said floating member approaches said waste outlet and eventually becomes seated within said waste outlet so as to form a seal and thereby preventing the loss of said flushing fluid disposed on the upper surface of the waste material.

15. The improvement of claim 14 wherein a flexible lip is disposed around an inner periphery of said waste outlet which improves the seal when said float member becomes seated within said waste outlet.

16. The improvement of claim 15 further comprising guide means coupled to said tank for guiding said float member to said waste outlet when said tank drains.

17. The improvement of claim 16 wherein said guide means is a funnel-like structure made of a perforated material, said structure defining an upper opening and tapering from said upper opening to define a lower opening, said lower opening being positioned over and approximately the same size as said waste outlet and said upper opening being positioned below said waste inlet whereby the solid phase waste matter arriving from said waste inlet tends to collect over said waste outlet, and when said tank is drained said float member is guided to said waste outlet by said structure.

18. The improvement of claim 14 wherein said flushing fluid pickup device comprises:

a pickup float which floats within said liquid waste compartment, said pickup float having at least one flushing fluid inlet disposed within said layer of flushing fluid;

a hose having a first end coupled to said pickup float and in communication with said at least one flushing fluid inlet and a second end coupled to a means for supplying said flushing fluid to said at least one toilet.

19. The improvement of claim 18 wherein said pickup float is suspended by said hose and said hose is substantially in the form of a coil.

20. The improvement of claim 19 wherein said pickup float comprises:

an upper pickup float member;

a lower pickup float member coupled to and spaced-apart from said upper member, said upper and lower members defining a plenum containing flushing fluid with said at least one flushing fluid inlet being disposed in said plenum;

whereby said flushing fluid which is supplied to said at least one toilet is drawn from said flushing fluid within said plenum.

21. The improvement of claim 20 wherein said hose acts as a spring and said pickup float further includes a weight coupled to said pickup float for counteracting a contraction force created by said hose.

* * * * *